US005992209A

United States Patent [19]

Hofele et al.

[11] Patent Number: 5,992,209

[45] Date of Patent: Nov. 30, 1999

[54] TRANSFER PRESS HAVING A LATERAL DEPOSITING ARRANGEMENT FOR THE TOOLING

[75] Inventors: Hans Hofele, Goeppingen; Matthias Speidel, Eschenbach, both of Germany

[73] Assignee: Schuler Pressen GmbH & Co., Germany

[21] Appl. No.: 09/080,249

[22] Filed: May 18, 1998

[30] Foreign Application Priority Data

May 16, 1997 [DE] Germany ..... 197 20 518

[51] Int. Cl.[6] ..... B21D 43/05

[52] U.S. Cl. ..... 72/405.1; 72/405.09; 72/405.01

[58] Field of Search ..... 72/405.01, 405.09, 72/405.1, 405.11, 405.13

[56] References Cited

U.S. PATENT DOCUMENTS

| | | | |
|---|---|---|---|
| 4,614,265 | 9/1986 | Glasberg | 72/405 |
| 4,866,974 | 9/1989 | Shiraishi | 72/405.1 |
| 4,970,888 | 11/1990 | Shiraishi | 72/405.1 |
| 5,131,256 | 7/1992 | Sofy | 72/405.13 |
| 5,140,839 | 8/1992 | Bruns | 72/405 |
| 5,248,288 | 9/1993 | Kamiya | 72/405.1 |

FOREIGN PATENT DOCUMENTS

| | | |
|---|---|---|
| 0 427 374 A1 | 5/1991 | European Pat. Off. . |
| 59-163036 | 3/1983 | Japan . |

*Primary Examiner*—Daniel C. Crane
*Attorney, Agent, or Firm*—Evenson McKeown Edwards & Lenahan P.L.L.C.

[57] ABSTRACT

A transfer press has sliding tables each assigned to one or several press stations and which, for the mold change, can be moved preferably laterally out of the transfer press. The sliding tables (or the molds disposed thereon) have receiving devices for the tooling which includes at least workpiece-specific holding devices of a transfer system which is used for transporting parts from press station to press station. For moving the sliding tables out of the transfer press, the receiving devices are positioned in separate depositing areas preferably provided laterally next to the molds. When the receiving devices are changed from their operative position taken up in the transfer system into the deposited position, the holding devices are swivelled by the receiving device which has a swivellable construction itself or a separate transfer device.

17 Claims, 4 Drawing Sheets

TRANSFER PRESS HAVING A LATERAL DEPOSITING ARRANGEMENT FOR THE TOOLING

BACKGROUND AND SUMMARY OF THE INVENTION

This application claims the priority of German application 197 20 518.6, filed May 16, 1997, the disclosure of which is expressly incorporated by reference herein.

The present invention relates to a transfer press for machining sheet metal parts, particularly a suction press, having at least one press station in which a bedplate is arranged which, as required, can be moved out of the press station and which is used for receiving at least one mold to be exchanged as required, for machining the sheet metal part, and a transfer device for feeding and/or removing the sheet metal parts to or from the press station in a defined transfer direction, the transfer device including at least one holding device to be changed when required for the temporary holding of the sheet metal parts which is situated in the transfer direction in front of and/or behind the mold when the mold is closed.

The present invention also relates to a process for the mold change and tooling change in such a transfer press having at least one bedplate on which at least one mold is held, and having a transfer device which has at least one holding device which can be changed as required.

Known transfer presses, as shown in EP-B-0 388 610, have a succession of press stations through which a workpiece has to travel in the transfer direction. The press stations are defined by molds divided into a top mold parts and a bottom mold part. The top mold part is fastened to a slide and the bottom mold part is disposed on a bedplate. A transfer device, for example, a two-axis transfer device with cross traverses, is used for the transport of the workpieces, on which cross traverses suction frames are held. In addition, the press has a press frame which includes press stands normally arranged between the working stations.

For the mold change, the bedplates with the molds disposed thereon are normally guided laterally out of the transfer press. They are moved through the press stands, the space conditions usually being such that the bedplates just fit through the press stands.

During the operation of the conventional transfer press, the suction frames or other holding devices pertaining to the transfer system are held between the molds, i.e., in the area for example, of the press stands when the molds close. The holding devices must first also take up this position if the top mold part is deposited on the bottom mold part in order to be able to move it out of the transfer press by way of the sliding table.

In addition to the mold change, the holding devices must also be changed. This should naturally take place in a manner which is as simple and requires expenditures of personnel which are as low as possible. At least some holding devices cannot, however, simply be guided laterally out of the transfer press because they would otherwise collide with the press stands.

Accordingly, an object of the invention is to provide a transfer press which permits a simple mold change including a simple tooling change, in which the tooling also includes holding devices which are part of a transfer system.

This object has been achieved in accordance with the present invention by providing a transfer press wherein at least one receiving device for the holding device is provided on the bedplate and/or the mold, and the receiving device holds the holding device during the mold change in a depositing area with an orientation which differs from the orientation of the holding device in the operating position. The process for changing the mold and the tooling involves steps wherein the holding device is swivelled out of its operative position into a changing position in which the holding device is held with respect to the transfer direction laterally next to the mold on a corresponding receiving device and in that the bedplate with the mold and the holding device (tooling) is moved out of the transfer press.

The transfer press of the present invention has a receiving device which has the purpose of depositing the tooling removed from the transfer system on the bedplate (or the mold) so that the bedplate with the mold and the tooling can be moved out of the transfer press.

According to the present invention, the tooling is held on the receiving device in an orientation and alignment which differs from the orientation in the transfer system. Thereby, for example, holding devices of the transfer system related to the tooling are deposited at a point on the bedplate at which, particularly with respect to the transfer direction, they do not project beyond the table contour.

A correspondingly provided transport device for the tooling is capable of changing the spatial orientation of the holding devices corresponding to the purpose so that the holding devices can be deposited at points on the bedplate which cannot be reached by the transfer system alone. Thereby, the holding devices are deposited at the otherwise not utilized points of the mold or the bedplate at which they do not hinder the moving-in and moving-out of the bedplate from the transfer press. In addition, the depositing points (receiving devices) may be selected such that the molds disposed on the bedplate are easily accessible, for example, to a crane.

If, as the result of the construction of the transfer press according to the present invention, on the side of the bedplate situated in the front and the rear in the transfer direction, additional space is not required for the holding devices (the tooling), the bed plates can be set up spaced from one another by only the with of a press stand. The distances between the bedplates and thus between the molds therefore become very short and permits a fast workpiece transfer and thus a high timing rate of the press.

The transport device for changing the tooling from the transfer system into the depositing area of the bedplates is advantageous particularly in transfer presses with two-axis transfers. The holding devices held on the cross traverses, for example, suction frames, suction spiders or the like, require a relatively large amount of space. In this case, the transport device permits the depositing at neutral points of the bedplate or of the mold. While the suction frames extend with the cross traverses in the operative position transversely to the transfer direction, they are deposited in the inoperative position in the longitudinal direction laterally to the molds. This is an area which is not crossed during the sheet metal part transport by the respective sheet metal part. Thereby, the transfer press can be constructed as short as possible in the transfer direction which benefits the stroke number.

The holding device can be held being oriented in the lateral area of the bedplate in the longitudinal direction as well as vertically. This depends on the concrete construction of the receiving device. The transport device correspondingly has a vertical, a horizontal or a diagonally arranged swivel axis. The transport device may be arranged on the bedplate or the mold and may, at the same time, be used as a receiving device for the holding system of the holding device in the inoperative position. The transport device can, however, also be arranged as a transfer device and be held on a press stand, that is, separately of the bedplate, in the holding device is transferred to the holder provided at the bedplate.

As required, particularly in the case of bedplates which have several molds disposed at a distance from one another, individual holding devices (tooling) may be deposited between the molds. This applies particularly to holding devices which, in the inoperative position are held above the bedplate between the molds and thus not in the area of press stands. These holding devices are not swivelled during the depositing on the bedplate.

The transfer device can be constructed such that the taken-over holding device is swivelled through the open mold or over the closed mold detached from the slide. The latter may be expedient if the transfer device carries out not only a swivel movement but simultaneously also a lifting movement, or if the depositing on the bedplate takes place relatively high.

According to the present invention, during the mold and tooling change, the tooling, which is part of the transfer system, is swivelled from its working position into a changing or inoperative position and is deposited on the bedplate. The bedplate, which is preferably constructed as a sliding table, is then moved out of the transfer press together with the mold and the tooling. By way of swivelling of the tooling, particularly of the holding devices, they can be transported to the lateral areas of the bedplate. Therefore, for depositing the holding device, no additional space needs to be provided which extends the bedplate in the transfer direction. In the lateral area, the holding device can be held horizontally or vertically, but at least in a plane which is aligned vertically and in the longitudinal direction. The holding device, which is, for example, constructed as a suction frame or a suction spider, can be held in a flat manner as well as may be held to be rotated about its longitudinal axis. For this purpose, the transport device has at least two swivelling or rotating axes.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
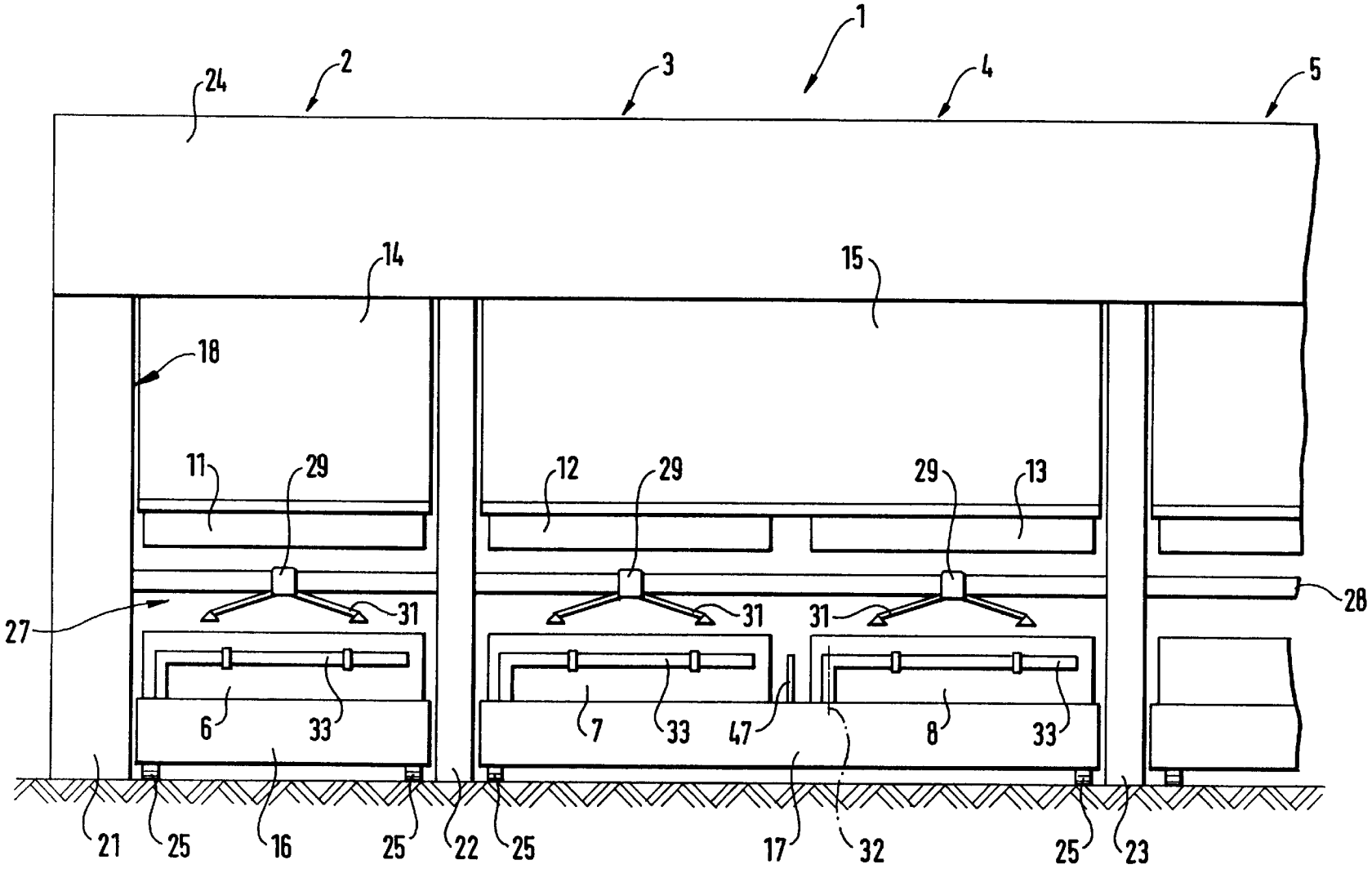
FIG. 1 is a schematic partial side view of a transfer press in accordance with the present invention.

FIG. 1 illustrates a transfer press 1 which has several press stations 2, 3, 4, 5. The press also has additional press stations which are conventional and thus not shown for sake of clarity. In each press station 2, 3, 4, 5, one mold respectively is arranged which consists of the bottom mold part 6, 7, 8 and of the top mold part 11, 12, 13. While the top mold parts 11, 12, 13, are detachably held on slides 14, 15, the bottom mold parts 6, 7, 8 rest on bedplates 16, 17.

A driving device is used to drive the slides 14, 15 and is carried by a press frame 18 which includes several press stands 21, 22, 23 carrying one or several heads 24. The slides 14, 15 are disposed in corresponding guides in a vertically slidable manner on the press stands 21, 22, 23. The bedplates 16, 17 are constructed as sliding tables which, being disposed on corresponding rollers 25, can be moved laterally out of the transfer press 1, as required.

A transfer system 27, which is constructed as a two-axis transfer, is used for transporting parts between the individual press stations 2, 3, 4, 5. The transfer system 27 includes transfer rails 28 which extend parallel to one another in the transfer direction longitudinally through the transfer press 1. The transfer rails 28 are connected with one another by cross traverses 29 which carry holding devices, such as suction frames 31 which have a specific construction depending on the workpiece and must be changed according to the requirements. The same applies to the top mold parts 11, 12, 13 and the bottom mold parts 6, 7, 8. As illustrated in the embodiment according to FIG. 2, the suction frames 31 may be constructed slightly narrower than the cross traverses 29. For example, two suction frames 31*a*, 31*b* will then be arranged side-by-side on one cross traverse 29. The suction frames 31 are carried by the cross traverses 29 and the transfer rails 28, and carry out a transfer movement in which they take the individual sheet metal parts out of a press station 2, 3, 4 and feed it to the respective downstream press station 3, 4, 5. When a sheet metal part is deposited in a press station 2, 3, 4, 5 and the concerned mold closes, the suction frames 31 must be held by the transfer system in corresponding spaces between the molds. The space between press station 2 and press station 3 is covered by the press stand 22. The press stand 23 covers the space between press stations 4, 5.

When the transfer press 1 is set up for a new workpiece, the top mold parts 11, 12, 13, the bottom mold parts 6, 7, 8 and the suction frames 31 must be exchanged. In this event, the guiding of the suction frames 31 out of the spaces covered by the press stands 22, 23 presents a certain difficulty. In order to eliminate this difficulty, receiving devices 33, which are disposed to be swivellable about a vertical axis 32, are arranged on the bedplates 16, 17, as illustrated separately in FIGS. 3 to 6. Such a receiving device 33 is a bent arm 35 which is provided with a swivel bearing 34 on the end side. The swivel bearing 34 disposes the arm 35 on a pin 36 connected with the respective bedplate 16, 17 so that a swivelling movement can be carried out in a horizontal plane.

The arm 35 carries to mutually spaced, vertical supports 37, 38 which are constructed as hollow box sections and are closed at both ends. In each vertical support 37, 38, a pneumatic cylinder 39, 41 is arranged which operates a vertically adjustable coupling pin 42, 43. As illustrated by a comparison of FIGS. 4 and 5, these pins can be advanced beyond the contact surface 44 (FIG. 6) constructed on the top side of the vertical support 37, 38 and can be withdrawn back thereunder.

The suction frame 31 held on the cross traverse 29 has corresponding receiving openings 46 for receiving the coupling pins 42, 43 on its underside. When the coupling pins 42, 43 engage in the receiving openings 46, the suction frame 31 is undisplaceably disposed on the swivellable receiving device. In addition to the receiving devices 33, receiving devices are provided on the bedplate 17 between the bottom mold parts 7, 8 which are stationary with respect to the bedplate 17. These are used for receiving suction frames 31 which stand over the bedplate 17 during the mold change.

Figure 2:
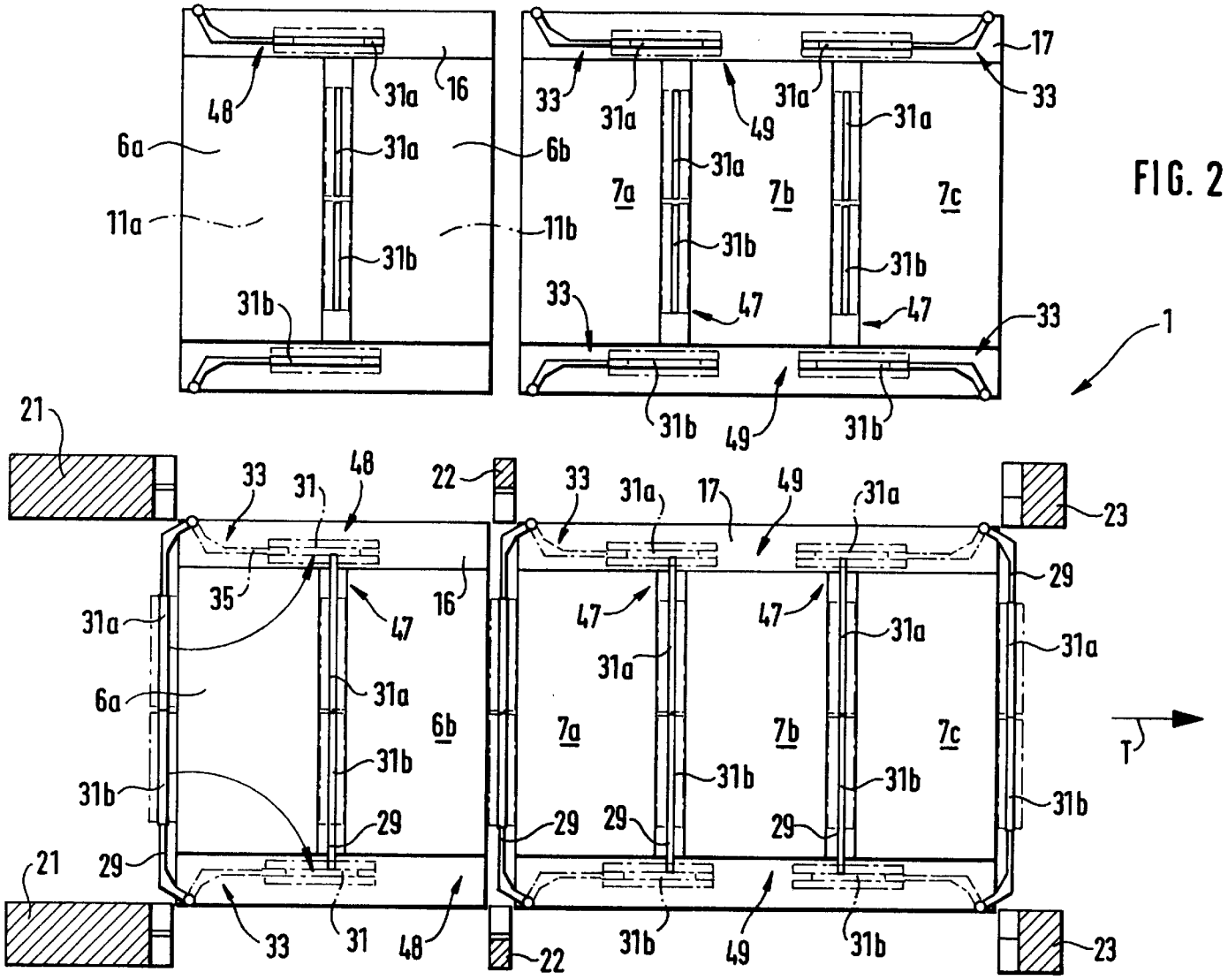
FIG. 2 is a sectional schematic plan view of a transfer press modified with respect to the transfer press according to FIG. 1 as well as a top view of additional sliding tables provided with molds and tooling.
Figure 3:
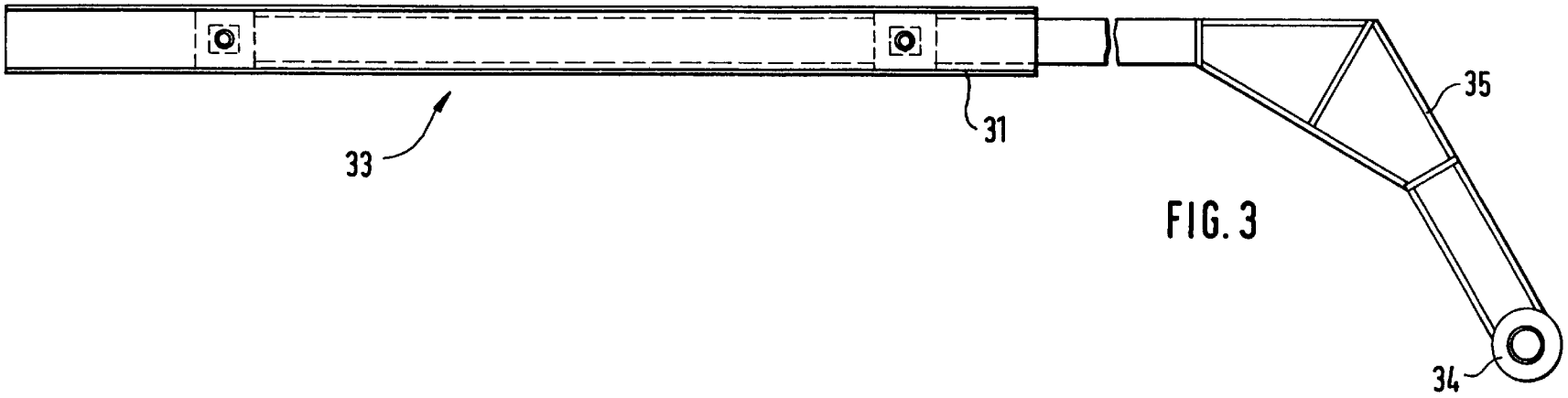
FIG. 3 is a simplified plan view of a receiving and transport device constructed as a swivelling arm for holding devices which are part of the transfer system of the transfer press of FIG. 1.

A modified embodiment of the transfer press 1 is illustrated in FIG. 2 as a horizontal sectional representation, the cut taking place in a plane between the top mold parts and the bottom mold parts. Two bedplates 16, 17 are provided which are arranged between press stands 21, 22, 23 and which are constructed as sliding tables for the lateral moving-out of the transfer press 1. The important difference between the transfer press 1 according to FIG. 1 and the transfer press 1 according to FIG. 2 is the number of bottom mold parts disposed on the bedplates 16, 17. The bedplate 16 of the transfer press 1 of FIG. 2 carries two bottom mold parts 6*a*, 6*b*, and the bedplate 17 carries three bottom mold parts 7*a*, 7*b*.

Measured in the transfer direction T, a distance is maintained between the bottom mold parts 6*a*, 6*b* which coincides with the distances between the other bottom mold parts 7*a*, 7*b*, 7*c*. In the transfer direction T, in the front and in the rear, the bottom mold parts 6*a*, 6*b* close off in each case essentially flush with the bedplate 16. The same applies to the bottom mold parts 7*a*, 7*c* of the bedplate 17. The distance between the bedplates 16, 17 and thus between the bottom mold parts 6*b*, 7*a* corresponds to the other distances between the bottom mold parts.

While the bottom mold parts 6*a*, 6*b*, 7*a*, 7*b*, 7*c* utilize each of the bedplates 16, 17 in their full length, they are narrower than the bedplates 16, 17 so that depositing areas 48, 49 for the suction frames 31 are formed laterally next to the bottom mold parts 6, 7. For transferring the suction frames 31 into the depositing areas 48, 49, the receiving devices 33 are swivellably disposed on the bedplates 16, 17. In addition, stationary receiving devices 47 are arranged between the bottom mold parts 6*a*, 6*b*; 7*a*, 7*b*, 7*c*. These receiving devices 47 receive suction frames 31 of the transfer system 27 whose cross traverses 29 consisting of carbon fiber material are arranged at regular distances indicated symbolically in FIG. 2 such that, when the molds close, the suction frames 31 will stand precisely between them.

The mold and tooling change will be described in the following by way of the transfer press 1 illustrated in FIG. 2. For the mold change, the transfer system is controlled such that all suction frames 31 stand between the molds (bottom mold parts 6*a*, 6*b*, 7*a*, 7*b*, 7*c*). Then the top mold parts are deposited on the bottom mold parts 6*a*, 6*b*, 7*a*, 7*b*, 7*c* and are separated from the slides. The receiving devices 33 are then swivelled into the respective depositing area 48, 49.

For the tooling transfer, i.e., of the suction frames 31, the receiving devices 33 are swivelled out of the depositing areas 48, 49 in each case by 90° about the vertical axis such that they stand below and parallel to the corresponding cross traverse 29. As illustrated in FIG. 2, each of receiving devices 33 assigned to the left-side depositing area 48 and the right-side depositing area 48 are length dimensioned so that they reach approximately to the center of the cross traverse 29. Thus, each receiving device 33 is used for receiving one suction frame 31*a*, 31*b*.

Figure 4:
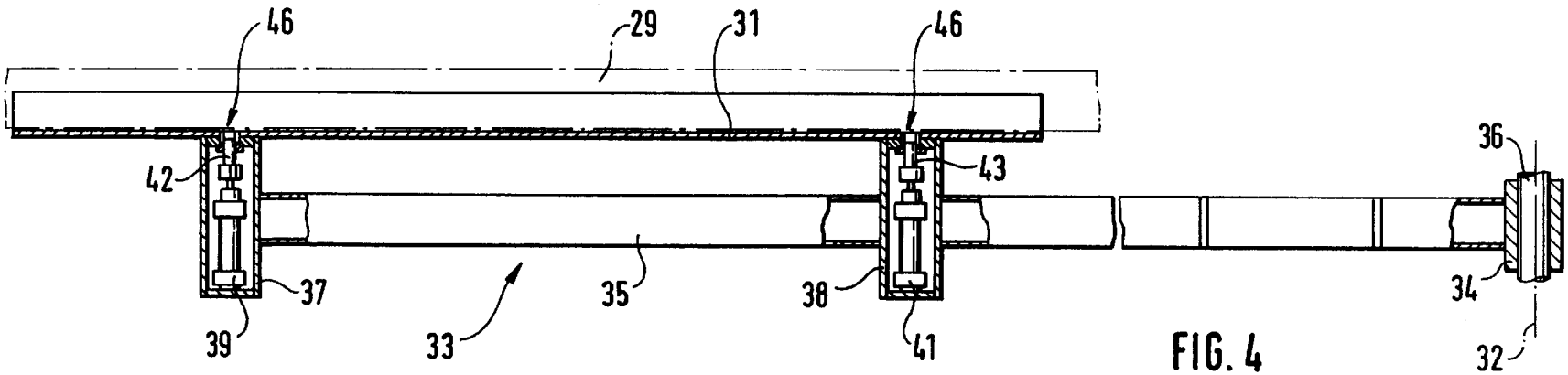
FIG. 4 is a partially sectional front view of the swivelling arm according to FIG. 3 in the coupling position in which it is coupled with the holding device.
Figure 5:
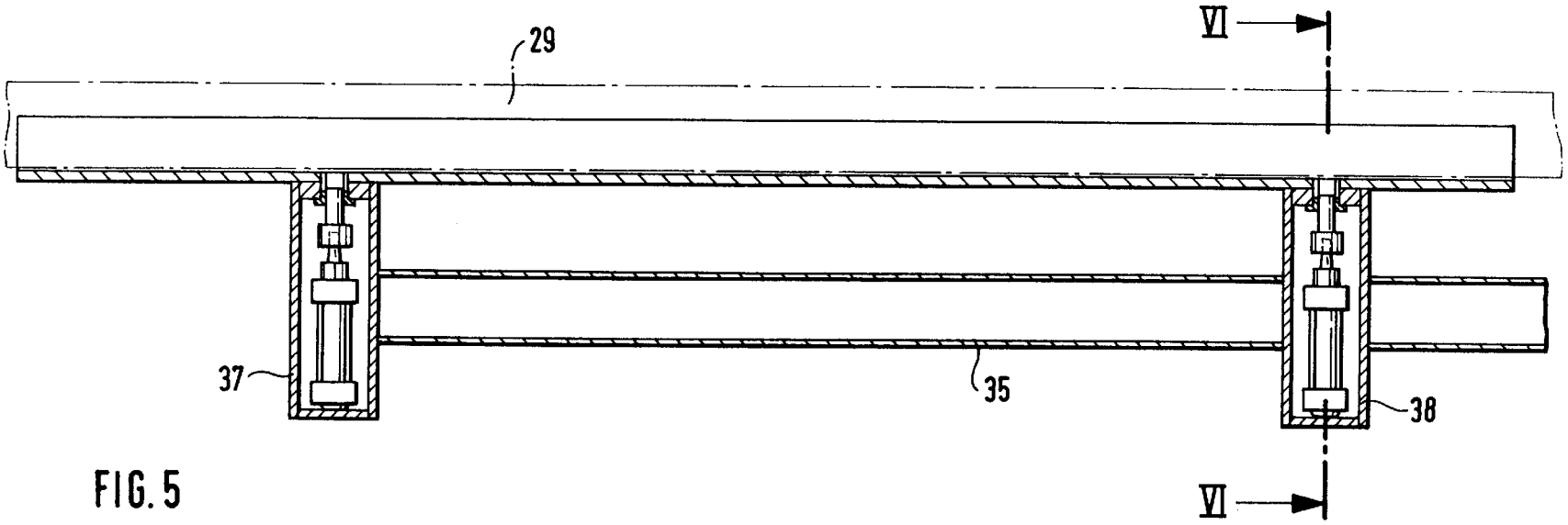
FIG. 5 is a schematic longitudinal sectional view of the swivelling arm of FIGS. 3 and 4 in an uncoupled position.
Figure 6:
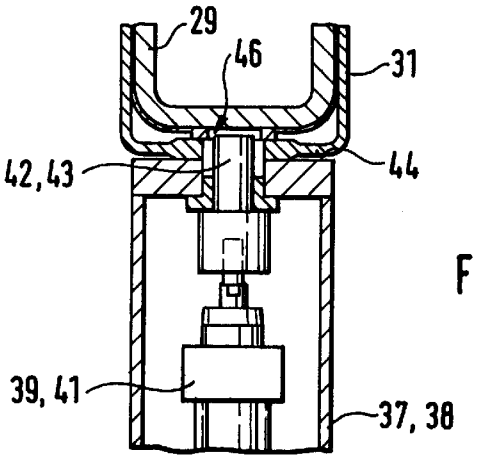
FIG. 6 is a cross-sectional view in a different scale of the swivelling arm of FIG. 5.

In the next step, the transfer rails 28 with the cross traverses 29 are lowered such that the suction frames 31*a*, 31*b* are disposed on the receiving devices 33. Simultaneously, the suction frames 31*a*, 31*b* situated between the molds are placed on the there-situated receiving devices 47. In this stage, the suction frames 31*a*, 31*b* are detached from the cross traverses and the pneumatic cylinders 39, 41 illustrated in FIG. 4 are operated so that the coupling pins 42, 43 secure the suction frames 31*a*, 31*b* on the receiving device 33. The detachment of the suction frames 31*a*, 31*b* takes place by corresponding coupling devices which are arranged between the cross traverse 29 and the suction frames 31*a*, 31*b* and can be controlled pneumatically, electrically or by a relative movement between the cross traverse 29 and the suction frames 31*a*, 31*b*.

After reception of the suction frames 31*a*, 31*b* by the receiving devices 33, 47, which has taken place so far, the cross traverses are lifted and the receiving devices 33 are swivelled into the depositing area 48. A conventional type of electrically, pneumatically or hydraulically operated driving device for the arm 35 can be used. As required, the receiving devices 33, 47 can also be lowered.

The suction frames 31*a*, 31*b* have now been swivelled out of their operative position into an inoperative position in which they are held in the depositing area 48 not crossed by the workpieces. The bedplate 16 can now be moved laterally out of the transfer press 1. The bedplate 16 will then be situated in the position outlined on the top portion in FIG. 2 and carries the molds 6*a*, 6*b* and the top mold parts 11*a*, 11*b*, as well as the suction frames 31*a*, 31*b* which are part of the tooling.

The mold change on the bedplate 17 basically takes place in a similar manner. However, the bedplate 17 has four swivellable receiving devices 33 arranged on its corners whereas the bedplate 16 has only two receiving devices 33. The swivelling movement of the receiving devices 33 and the depositing of the suction frames 31*a*, 31 on the receiving devices 33, 41 basically takes place in the same manner as described above, after which the bedplate 17 can be moved out between the press stands 22, 23. The bedplate 17 is illustrated in its moved-out position at the top portion of FIG. 2.

As an alternative, transfer devices can be disposed on the press stands 21, 22, 23, which transfer devices lift the suction frames 31*a*, 31*b* off the cross traverses 29 and transfer them to fixed receiving devices arranged in the depositing areas 48, 49. In addition, embodiments are contemplated in which the receiving devices 33 are swivelled over the closed molds as well as embodiments in which the receiving devices 33 are swivelled through the open mold. As required, lifting devices may be provided so that the receiving devices can be lifted and lowered.

In embodiments with narrower cross traverses 19, it may be sufficient to provide only one receiving device 33 for the holding devices or devices held on the cross traverse 29. The length of the receiving device 33 then corresponds approximately to the width of the cross traverse 29.

For saving more space, the suction frames 31 can have movably disposed suction arms disposed on the suction frame 31. Thereby, they can, for example, be swivelled about a vertical axis, so that, when they are not in use, they permit a shortening of the suction frame 31 in the transfer direction.

In a transfer press 1 of the present invention, sliding tables 16, 17 are each assigned to one or several press stations and which can be moved out of the transfer press 1 preferably laterally for a mold change. The sliding tables 16, 17 or the molds disposed on them have receiving devices 33, 47 for the tooling which includes at least workpiece-specific holding devices 31 of a transfer system 27 for transporting parts from one press station to the next.

For movement of the sliding tables 16, 17 out of the transfer press 1, the receiving device 33 is positioned in separate depositing areas 48, 49. These depositing areas 48, 49 are preferably provided laterally next to the molds and are arranged such that, relative to the driving direction of the respective sliding table 16, 17, they do not enlarge its width (i.e., relative to the transfer direction, its length). During changing of the receiving devices 31 from an operative position taken up in the transfer system 27 into a depositing position, the holding devices are swivelled. Either the receiving device 33, which itself has a swivellable construction, or a separate transfer device is used for this purpose.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A transfer press for machining sheet metal parts, comprising at least one press station having a bedplate operatively arranged therein so as to be predeterminately movable out of the at least one press station and to at least one mold configured to be opened, closed and exchanged as required, for machining the sheet metal parts, a transfer device for at least one of feeding and removing the sheet metal parts to or from the at least one press station in a defined transfer direction and having at least one holding device configured to be selectively arranged to extend in a first direction transversely of the bedplate for temporary holding of the sheet metal parts and situated, as viewed in the defined transfer direction, downstream of and/or upstream of the at least one mold when the mold is closed, and at least one receiving device for the at least one holding device operatively arranged on at least one of the bedplate and/or the at least one mold, and configured to hold the at least one holding device during a mold change in a depositing area wherein the at least one receiving device comprises at least one transport device for transferring the at least one holding device from an operative position thereof taken up in the transfer system into a deposited position thereof for the mold change by positioning the holding device to extend transversely to said first direction.

2. The transfer press according to claim 1, further comprising a two-axis transfer system of at least one cross traverse for carrying the at least one holding device.

3. The transfer press according to claim 1, wherein the at least one holding device is an elongated suction frame extending in a direction transversely to the defined transfer direction and transversely spanning a transfer path of the sheet metal parts at least in sections.

4. The transfer press according to claim 1, wherein the at least one transport device is a swivelling device.

5. The transfer press according to claim 4, wherein the swivelling device has a vertical swivel axis.

6. The transfer press according to claim 4, wherein the swivelling device has a swivelling arm with coupling devices configured for coupling of the at least one holding device.

7. The transfer press according to claim 6, wherein the swivelling arm is configured to carry at least one bearing element configured to hold the at least one holding device, and the coupling devices include at least one force-operated pin configured to be engaged with the coupling devices and disengaged therefrom for securing the position of the coupling devices.

8. The transfer press according to claim 4, wherein the swivelling device is constructed such that the received at least one holding device, during transfer from an operative position thereof, in which it is received on the transfer device, can be swivelled into a changing position thereof, in which it is swivellably held, over the at least one closed mold which rests on the bedplate, a top mold part of the at least one closed mold being separated from a slide comprising part of the press station.

9. The transfer press according to claim 4, wherein the swivelling device is constructed such that the received at least one holding device, during transfer from an operative position thereof in which it is held on the transfer device, is swivellable into a changing position thereof, in which it is swivellably held, through the open mold having a bottom mold part which rests on the bed plate and a top mold part which is held by a slide associated with the press station at a vertical distance from the bottom mold part.

10. The transfer press according to claim 4, wherein the at least one receiving device is provided on the bedplate and is simultaneously usable as the at least one receiving device.

11. The transfer press according to claim 1, wherein the at least one press stand is associated with the press station and carries the at least one transport device.

12. The transfer press according to claim 1, wherein, at at least one edge of the bedplate situated one of frontwardly and rearwardly in the defined transfer direction, the mold closes off flush with the one edge, and the transport device is arranged to transfer the at least one holding device associated with the bedplate into the lateral depositing area and, with the bedplate configured to carry several molds, at least one receiving device (47) between the molds is provided for the at least one holding device used for the workpiece transport between the molds.

13. The transfer press according to claim 1, wherein the length of the bedplate measured in the defined transfer direction corresponds substantially to a distance between two press stands adjacent to the bedplate in the defined transfer direction, and the width of the mold measured in the transverse direction is smaller than the width of the bedplate.

14. The transfer press according to claim 3, wherein the suction frame has suction arms with suction devices movably arranged on an end side thereof.

15. A transfer press for machining sheet metal parts, comprising at least one press station having a bedplate operatively arranged therein so as to be predeterminately movable out of the at least one press station and to at least one mold configured to be opened, closed and exchanged as required, for machining the sheet metal parts, a transfer device for at least one of feeding and removing the sheet metal parts to or from the at least one press station in a defined transfer direction and having at least one holding device configured to be selectively arranged transversely of the bedplate for temporary holding of the sheet metal parts and situated, as viewed in the defined transfer direction, downstream of and/or upstream of the at least one mold when the mold is closed, and at least one receiving device for the at least one holding device operatively arranged on at least one of the bedplate and/or the at least one mold, and configured to hold the at least one holding device during a mold change in a depositing area wherein the at least one receiving device comprises at least one transport device for transferring the at least one holding device from an operative position thereof taken up in the transfer system into a deposited position thereof for the mold change, wherein the at least one receiving device is configured to transfer the sheet metal parts into a lateral area of the bedplate which constitutes the depositing area and which the sheet metal parts do not cross during transport thereof.

16. A process for the mold and tooling change in the case of a transfer press having at least one bedplate on which at least one mold is held, and a transfer device which has at least one predeterminately changeable holding device, extending transversely of the bedplate to extend in a first direction, as viewed on a transfer direction, in an operative position comprising the steps of swivelling the holding device out of the operative position thereof into a changing position in the transfer direction in which the holding device is held with respect to a transfer direction laterally next to the mold on a corresponding receiving device so as to extend transversely to said first direction, and moving the bedplate with the mold and the holding device out of the transfer press.

17. A process for the mold and tooling change in the case of a transfer press having at least one bedplate on which at least one mold is held, and a transfer device which has at least one predeterminately changeable holding device comprising the steps of swivelling the holding device out of the operative position thereof into a changing position in which the holding device is held with respect to a transfer direction laterally next to the mold on a corresponding receiving device, and moving the bedplate with the mold and the holding device out of the transfer press, wherein the holding device which, in the operative position, is aligned transversely to the transfer direction, in the changing position, is held in a plane which is aligned longitudinally and vertically.

* * * * *